United States Patent [19]

Leonard, Jr. et al.

[11] 4,168,875

[45] Sep. 25, 1979

[54] ELECTRICAL CONNECTOR WITH WELDING FIXTURE-CONNECTOR BODY

[75] Inventors: Robert D. Leonard, Jr., Poland; Charles R. Nestor, Niles, both of Ohio

[73] Assignee: General Motors Corporation, Detroit, Mich.

[21] Appl. No.: 920,135

[22] Filed: Jun. 28, 1978

[51] Int. Cl.[2] ..... H01R 13/00

[52] U.S. Cl. ..... 339/147 R

[58] Field of Search ..... 339/182 R, 182 RS, 182 T, 339/147 R, 147 P, 147 C, 151 R, 151 A, 151 B, 151 C, 151 M, 198 P; 174/72 R

[56] References Cited

U.S. PATENT DOCUMENTS 2,377,181 5/1945 Schey, Jr. ..... 339/198 P 3,016,512 1/1962 Borchard ..... 339/198 P

*Primary Examiner*—Joseph H. McGlynn
*Assistant Examiner*—John S. Brown
*Attorney, Agent, or Firm*—F. J. Fodale

[57] ABSTRACT

A pig tail is attached to an oxygen sensor by a sealed electrical connector having four terminals welded to respective contacts of the four way oxygen sensor post terminal. The electrical connector includes a welding fixture-connector body of dielectric material which prearranges the terminals for assembly to the post terminal as a unit. After assembly, the body serves as a welding fixture and for this purpose has diametrically opposed windows which provide access for the welding electrodes. The connector is sealed by a seal boot which is carried by a grommet which slides on the pig tail leads.

3 Claims, 9 Drawing Figures

ELECTRICAL CONNECTOR WITH WELDING FIXTURE-CONNECTOR BODY

This invention relates generally to electrical connectors and more particularly to electrical connectors having a plurality of terminals which are to be welded to a post terminal means.

The object of the invention is to provide simple and reliable means for prearranging a plurality of terminals for assembly to a post terminal means as a unit and subsequent welding of the terminals to the post terminal means.

Broadly this means takes the form of a specially adapted connector body which prearranges a plurality of terminals for assembly to a post terminal means as a unit and thereafter serves as a welding fixture for holding the terminals in position during the welding operation.

Other objects and features of the invention will become apparent to those skilled in the art as the disclosure is made in the following detailed description of a preferred embodiment of the invention as illustrated in the accompanying sheet of drawing in which.

Figure 1:
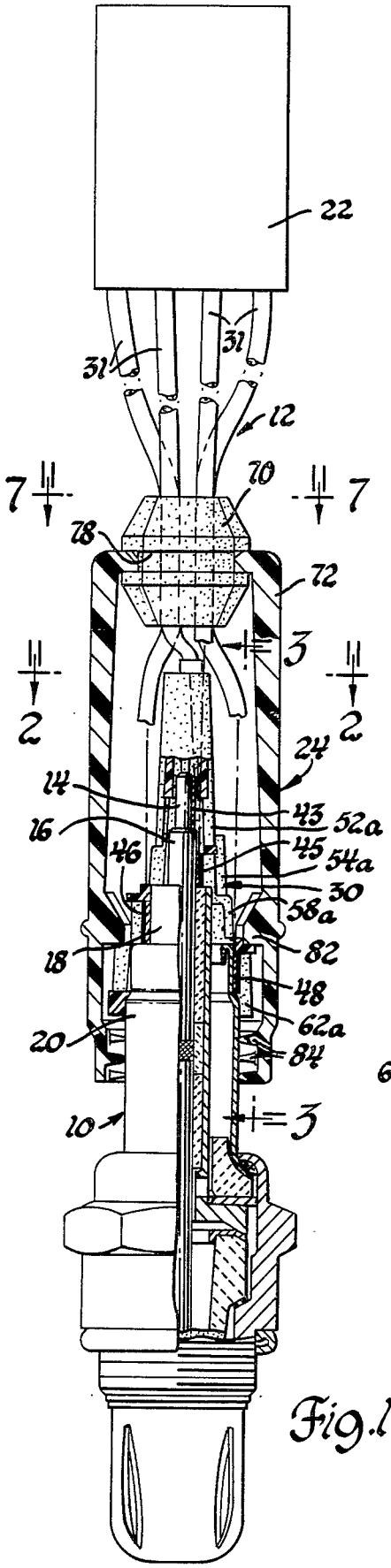
FIG. 1 is a partially sectioned elevation of a pig tail having an electrical connector of this invention attached to an oxygen sensor.
Figure 2:
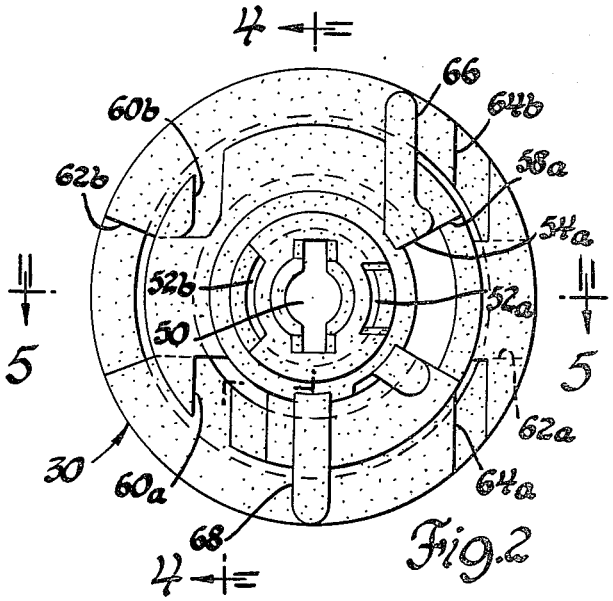
FIG. 2 is a view taken substantially along the line 2—2 of FIG. 1 looking in the direction of the arrows.
Figure 3:
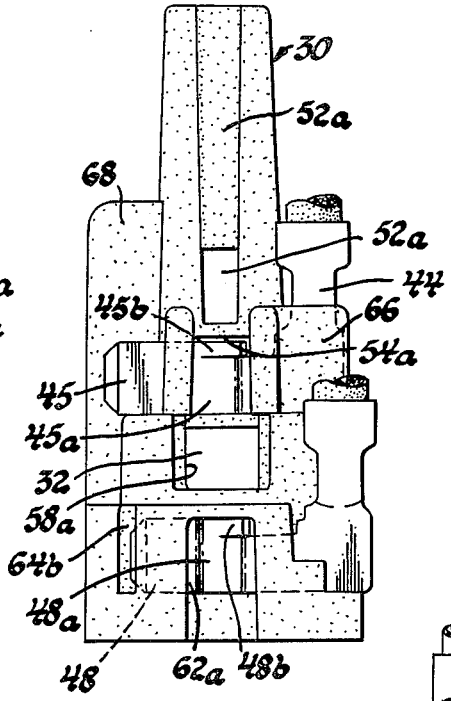
FIG. 3 is a view taken substantially along the line 3—3 of FIG. 1 looking in the direction of the arrows.
Figure 4:
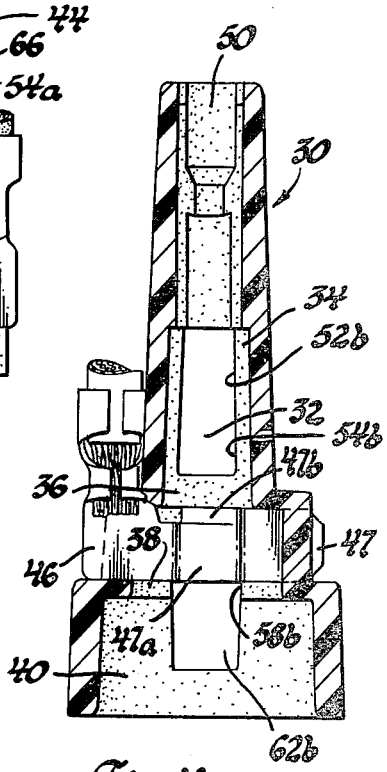
FIG. 4 is a section taken substantially along the line 4—4 of FIG. 2 looking in the direction of the arrows.

Referring now to the drawing and more particularly to FIG. 1, the assembly shown therein comprises an oxygen sensor 10 and an attached pig tail 12. The oxygen sensor 10 is a device which is used to detect the amount of oxygen in the exhaust gases of an internal combustion engine or the like by means of an electrode which is exposed to the exhaust gases on one side and to ambient air on the other side. The electrode generates a signal representative of the relative concentrations of oxygen in the ambient air and exhaust gases. The generated signal in turn is used to control fuel-air ratio of the combustible mixture for the internal combustion engine. The particular oxygen sensor illustrated is of the heated type incorporating a heater element for the electrode.

The oxygen sensor 10 has a post terminal means which provides four concentric longitudinally spaced annular contacts for the heater and electrode elements. The central post 14 is the power input for the heater element. It protrudes from a larger annular ground post 16 for the heater element. A still larger annular post 18 is electrically connected to the air side of the electrode. The upper portion of the sheet metal shell forms the fourth and largest annular post 20 which is electrically connected to the exhaust gas side of the electrode and ground.

The pig tail 12 serves to connect the four posts 14, 16, 18 and 20 to an electrical circuit via a suitable wiring harness (not shown) to which it is connected by the schematically illustrated connector 22. The pit tail 12 is attached to the oxygen sensor 10 by a sealed electrical connector 24 which incorporates the invention.

An important feature of the invention is the connector body 30 which is specially adapted to prearrange the four terminals at ends of the four pig tail leads 31 for attachment to the post terminals 14, 16, 18 and 20 as a unit and to then serve as a welding fixture while the four terminals are welded to the four post terminals.

Figure 5:
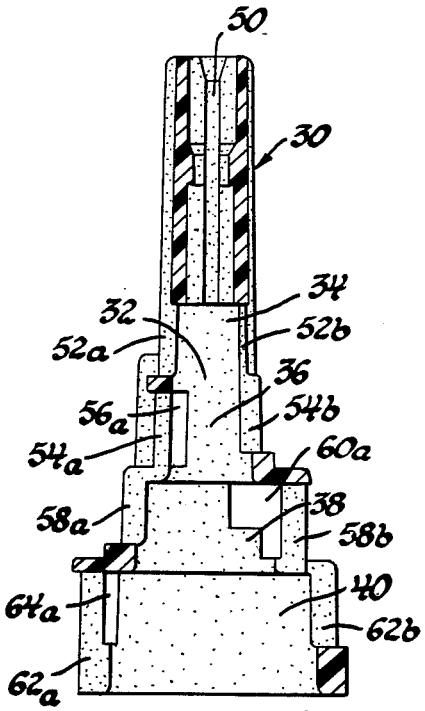
FIG. 5 is a section taken substantially along the line 5—5 of FIG. 2 looking in the direction of the arrows.
Figure 7:
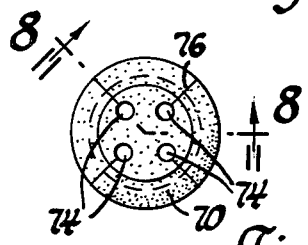
FIG. 7 is a view taken substantially along the line 7—7 of FIG. 1 looking in the direction of the arrows.
Figure 8:
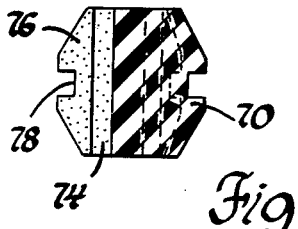
FIG. 8 is a section taken substantially along the line 8—8 of FIG. 7 looking in the direction of the arrows.
Figure 9:
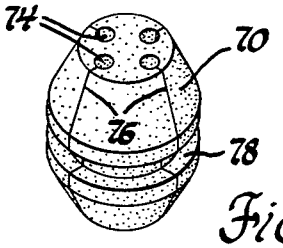
FIG. 9 is a perspective view of the grommet shown in FIGS. 1, 7 and 8.
Figure 6:
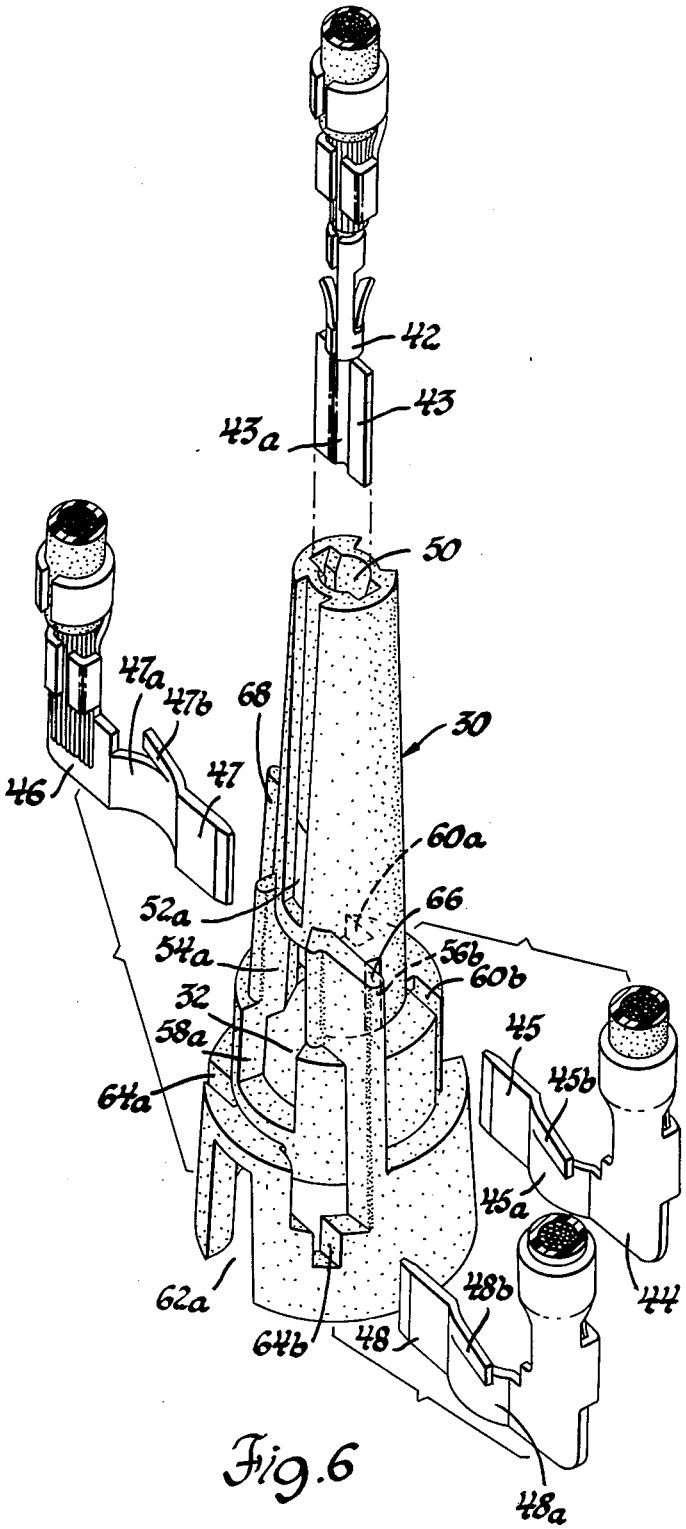
FIG. 6 is an exploded perspective view of the electrical connector shown in FIG. 1.

Referring now to FIGS. 1–6 and particularly to FIGS. 5 and 6, the connector body 30 is of dielectric material and shaped as a hollow tower which defines a longitudinal open ended chamber 32. The longitudinal chamber 32 may be divided into four concentric serially arranged portions 34, 36, 38 and 40 which are associated with respective ones of the four terminals 42, 44, 46 and 48 attached to the pig tail leads 31.

The uppermost portion 34 of the chamber 32 has a longitudinal terminal receiving slot 50 at its upper end and diametrically opposed windows 52*a* and 52*b* at its lower end. The slot 50 receives and retains the blade terminal 42 so that the blade portion 43 blocks the window 52*b*. The blade portion 43 preferably includes a part circular indent 43*a* which matches the curvature of the central post 14.

The upper intermediate portion 36 of the chamber 32 has diametrically opposed windows 54*a* and 54*b*. It also has chordally opposed slots 56*a* and 56*b* which are orthogonally arranged with respect to the windows 54*a* and 54*b*. The slots 56*a* and 56*b* receive the flag terminal 44 to position the flag 45 so that curved mid-portion 45*a* blocks the window 54*a*. The curved mid-portion 45*a* has a tang 45*b* which engages the edge of the window 54*a* to retain the flag terminal 44.

The lower intermediate portion 38 has diametrically opposed windows 58*a* and 58*b* and chordally opposed slots 60*a* and 60*b* arranged orthogonally. The slots 60*a* and 60*b* receive the flag terminal 46 to position the flag 47 so that the curved mid-portion 47*a* blocks the window 58*b*. It is retained by tang 47*b* engaging the edge of the window 58*b*.

The lowermost portion 40 of the chamber 32 has diametrically opposed windows 62*a* and 62*b* and chordally opposed slots 64*a* and 64*b* which receive the flag terminal 48 and retain its curved mid-portion 48*a* in a position to block the window 62*a*. The flag terminal 48 is retained by the tang 48*b*.

The windows 52*a*, 54*a*, 58*a* and 62*a* are aligned longitudinally on one side of the connector body 30. The windows 54*a* and 58*a* merge into each other to facilitate molding of the part. On the opposite side of the connector body 30, the windows 52*b*, 54*b*, 58*b* and 62*b* are aligned longitudinally. The windows 52*b* and 54*b* merge into each other and the windows 58*b* and 62*b* merge into each other to facilitate molding. The chordally opposed slot pairs 56*a* and 56*b*; 60*a* and 60*b*; and 64*a* and 64*b* are parallel and offset from the longitudinal axis of the chamber 32. The slot pair 60*a* and 60*b* is offset in an opposite direction from the other two pairs.

The body 30 has two external longitudinal ribs 66 and 68. The rib 66 is located between the slots 56*b* and 64*b* and serves to insulate the external portions of the terminals 44 and 48 from each other. The rib 68 is located between the slots 56*a* and 60*b* and serves to insulate the external portions of the terminals 44 and 46 from each other.

After the terminals 42, 44, 46 and 48 are secured to the insulator body 30 in the manner described above, the insulator body 30 is simply plugged onto the post terminal means of the oxygen sensor 10. In the assembled position, the center post 14 is received in the uppermost portion 34 of the chamber 32 where it is engaged by the blade 43 blocking the window **52*b*. The diametrically opposed portion of the center post 14 is exposed via the window 52*a*. The blade 43 and center post 14 are thus positioned and accessible via the windows 52*a* and 52*b* for engagement by a pair of welding electrodes for resistance welding the blade 43 to the center post 14**.

Similarly, the annular posts 16, 18 and 20 are respectively disposed in portions 36, 38 and 40 of the chamber 32 where each is engaged by a flag of an associated terminal blocking one of the associated windows and exposed via the other of the associated windows. Thus, when the connector body 30 is plugged onto the post terminal means, it is specially adapted to act as a welding fixture which holds the prearranged terminals 42, 44, 46 and 48 in position for welding to the respective posts 14, 16, 18 and 20 with the window pairs **50*a* and 50*b*; 54*a* and 54*b*; 58*a* and 58*b* and 62*a* and 62*b*** permitting access for the welding electrodes.

The electrical connector 24 also includes a vented seal which protects the welded connections against contamination and permits ambient air to reach the air electrode of the oxygen sensor.

The vented seal comprises a grommet 70 and a boot 72. The grommet 70 has four round lead receiving passages 74 which reach the outer surface via assembly slits 76 which permit sideway insertion of the pig tail leads 31. The grommet 70 also has a circumferential groove 78 which receives and seals an upper end inturned flange 80 of the boot 72. The boot 72 has internal ribs 82 which engage the enlarged lower end of the connector body 30 to properly locate the seal boot 72 in the sealing position where the lower end of the seal boot 72 extends below the connector body 30. The lower end has three inner sealing ribs 84 which engage the lower end portion of the sheet metal shell 20. The ribs 84 are interrupted at different locations to provide a tortuous vent path for ambient air to reach the inside of the seal boot 72. Once inside the seal boot, the ambient air reaches the air electrode of the oxygen sensor via spaces between the upper end of the shell 20 and the annular contact 18. The grommet 70 is slidable on the pig tail leads 31. The grommet 70 and the seal boot 72 are in a raised non-interfering position during the welding operation and are slid into the sealing position shown in FIG. 1 after welding is completed.

We wish it to be understood that we do not desire to be limited to the exact details of construction shown and described, for obvious modifications will occur to a person skilled in the art.

What is claimed is:

1. An electrical connector having a plurality of terminals to be welded to respective contacts of a multi-contact post terminal means comprising:

a welding fixture-connector body of dielectric material, having a longitudinal chamber shaped to receive a multi-contact post terminal means longitudinally through an opening at one longitudinal end thereof, said longitudinal chamber having a plurality of chamber portions adapted to receive respective contacts of a multi-contact post terminal means when the post terminal means is disposed in the chamber, said body having a pair of diametrically opposed windows associated with each chamber portion to provide access for a pair of welding electrodes, and slot means associated with each chamber portion for receiving a terminal and locating a weldable portion of the terminal in the chamber portion in a position blocking one of said pair of windows.

2. An electrical connector having a plurality of terminals to be welded to respective contacts of a multi-contact post terminal means comprising:

a welding fixture-connector body of dielectric material, having a longitudinal chamber shaped to receive a multi-contact post terminal means longitudinally through an opening at one longitudinal end thereof, said longitudinal chamber having a plurality of serially arranged chamber portions adapted to receive respective contacts of a multi-contact post terminal means when the post terminal means is disposed in the chamber, said body having a pair of diametrically opposed windows associated with each chamber portion to provide access for a pair of welding electrodes, a longitudinal slot at an opposite longitudinal end for receiving a terminal and locating a weldable portion of the terminal in an adjacent chamber portion in a position blocking one of said pair of windows, and a chordally opposed pair of slots associated with each of the remaining chamber portions for receiving a terminal and locating a weldable portion thereof in the associated chamber in a position blocking one of said pair of windows.

3. An electrical connector having a plurality of terminals to be welded to respective contacts of a multi-contact post terminal means comprising:

a welding fixture-connector body of dielectric material, having a longitudinal chamber shaped to receive a multi-contact post terminal means longitudinally through an opening at one longitudinal end thereof, said longitudinal chamber having a plurality of concentric serially arranged chamber portions adapted to receive respective annular, longitudinally spaced contacts of a multi-contact post terminal means when the post terminal means is disposed in the chamber, said body having a pair of diametrically opposed windows associated with each chamber portion to provide access for a pair of welding electrodes, said pairs of windows being longitudinally aligned, a longitudinal slot at an opposite longitudinal end for receiving a terminal and locating a weldable portion of the terminal in an adjacent chamber portion in a position blocking one of said pair of windows, and a chordally opposed pair of slots associated with each of the remaining chamber portions for receiving a terminal and locating a weldable portion thereof in the associated chamber in a position blocking one of said pair of windows, said chordally opposed pairs of slots being alternately spaced from the longitudinal axis of the chamber in opposite directions.

* * * * *